US010406812B2

(12) United States Patent
Taniuchi et al.

(10) Patent No.: US 10,406,812 B2
(45) Date of Patent: Sep. 10, 2019

(54) LIQUID DISCHARGE APPARATUS

(71) Applicant: SEIKO EPSON CORPORATION, Tokyo (JP)

(72) Inventors: Akinori Taniuchi, Matsumoto (JP); Shunya Fukuda, Azumino (JP); Akira Miyagishi, Matsumoto (JP); Masayuki Hayashi, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/837,746

(22) Filed: Dec. 11, 2017

(65) Prior Publication Data

US 2018/0170049 A1 Jun. 21, 2018

(30) Foreign Application Priority Data

Dec. 21, 2016 (JP) ..... 2016-248414

(51) Int. Cl.

| | |
|---|---|
| ***B41J 2/14*** | (2006.01) |
| ***B41J 2/145*** | (2006.01) |
| ***B41J 2/15*** | (2006.01) |
| ***B41J 2/155*** | (2006.01) |

(52) U.S. Cl.

CPC ..... *B41J 2/1433* (2013.01); *B41J 2/145* (2013.01); *B41J 2/14201* (2013.01); *B41J 2/14233* (2013.01); *B41J 2/15* (2013.01); *B41J 2/155* (2013.01); *B41J 2202/11* (2013.01); *B41J 2202/20* (2013.01)

(58) Field of Classification Search

None

See application file for complete search history.

(56) References Cited

U.S. PATENT DOCUMENTS

2005/0231538 A1* 10/2005 Deng ..... B41J 2/16579 347/9
2012/0001986 A1* 1/2012 Kim ..... B41J 2/14233 347/47
2013/0127955 A1* 5/2013 Ataka ..... B41J 2/04 347/70
2015/0029271 A1* 1/2015 Domae ..... B41J 2/14209 347/71

FOREIGN PATENT DOCUMENTS

JP 2016-179622 10/2016
JP 179622 A * 10/2016 ..... B41J 2/14

* cited by examiner

*Primary Examiner* — Matthew Luu
*Assistant Examiner* — Tracey M McMillion
(74) *Attorney, Agent, or Firm* — Workman Nydegger

(57) ABSTRACT

A liquid discharge apparatus includes: a nozzle plate having a plurality of nozzles; a pressure chamber communicating with the nozzle; and a pressure generating element, in which each of the nozzles is formed by communicating a first opening portion and a second opening portion, when two nozzles adjacent to each other are represented by a first nozzle and a second nozzle, the second opening portion of the first nozzle and the second opening portion of the second nozzle are disposed along a first direction, each of the second opening portions extends in a second direction, and an inner diameter of the second opening portion in the second direction is larger than an inner diameter of the first opening portion, the first opening portion of the first nozzle and the first opening portion of the second nozzle are disposed so as to be shifted from each other in the second direction.

7 Claims, 11 Drawing Sheets

LIQUID DISCHARGE APPARATUS

The entire disclosure of Japanese Patent Application No. 2016-248414, filed Dec. 21, 2016 is expressly incorporated by reference herein.

BACKGROUND

1. Technical Field

The present invention relates to technology for discharging liquid such as ink or the like.

2. Related Art

In a liquid discharge apparatus which discharges liquid such as ink or the like through a nozzle, in order to improve positional accuracy or processing accuracy of the nozzle, controllability of a discharge amount in maintenance (for example, flushing), or the like, as in JP-A-2016-179622, there are cases where a first opening portion (first cylindrical portion) and a second opening portion (second cylindrical portion) which communicate with each other configure one nozzle, and the second opening portion has an inner diameter larger than that of the first opening portion.

SUMMARY

However, in the configuration of JP-A-2016-179622, if the first opening portions are linearly disposed at a high density, a disposition interval of a plurality of nozzles becomes short. Accordingly, since a liquid droplet of liquid discharged through the nozzle is easily affected by a vortex flow generated in accordance with liquid discharged through other nozzles or self-jet, there is a risk that a landing position to a medium shifts and a wind ripple or the like occurs. On the other hand, if the nozzles including the second opening portion are arranged in a staggered shape as a whole, a disposition density of the nozzles can be reduced, but, depending on positions of the first opening portion and the second opening portion, discharge characteristics of the nozzle are largely affected, and there is a risk that variation in the discharge characteristics occurs. An advantage of some aspects of the invention is to suppress a shift of a landing position of a liquid droplet to a medium, while reducing variation in the discharge characteristics of a nozzle.

A liquid discharge apparatus according to an aspect of the invention includes: a nozzle plate having a plurality of nozzles; a pressure chamber communicating with the nozzle; and a pressure generating element causing a change in pressure of liquid in the pressure chamber to be generated and the liquid to be discharged through the nozzle, in which each of the nozzles is formed by communicating a first opening portion on a discharge side of the liquid and a second opening portion on the pressure chamber side, when two nozzles adjacent to each other among the nozzles are represented by a first nozzle and a second nozzle, the second opening portion of the first nozzle and the second opening portion of the second nozzle are disposed along a first direction, each of the second opening portions extends in a second direction orthogonal to the first direction and an inner diameter thereof in the second direction is larger than an inner diameter of the first opening portion, the first opening portion of the first nozzle and the first opening portion of the second nozzle are disposed so as to be shifted from each other in the second direction. According to the above-described configuration, in the first nozzle and the second nozzle adjacent to each other, the second opening portions are disposed along the first direction and the first opening portions are disposed so as to be shifted in the second direction. Accordingly, in comparison with a case where not only the first opening portions but also the second opening portions are shifted in the second direction, variation in the discharge characteristics of the nozzle can be suppressed. In addition, the first opening portions are disposed so as to be shifted in the second direction, a liquid droplet of liquid discharged through the nozzle is therefore less affected by a vortex flow. Accordingly, a shift of a landing position of the liquid droplet to a medium can be suppressed, and it is thus possible to suppress generation of a wind ripple or the like. As described above, according to the configuration, while reducing variation in the discharge characteristics of the nozzle, it is possible to suppress the shift of the landing position of the liquid droplet to the medium.

It is preferable that an arrangement of the first opening portion of the first nozzle and the first opening portion of the second nozzle adjacent to each other do not include an arrangement in which the first opening portion of one of the first nozzle and the second nozzle is disposed at the center portion of the second opening portion in a lengthwise direction, and the first opening portion of the other is disposed at an endmost portion of the second opening portion in the lengthwise direction. According to the above-described configuration, the arrangement of the first opening portion of the first nozzle and the first opening portion of the second nozzle adjacent to each other does not include the arrangement in which the first opening portion is disposed at the center portion of the second opening portion in the lengthwise direction and the first opening portion is disposed at the endmost portion of the second opening portion in the lengthwise direction, that is, an arrangement in which a difference in inertance is maximized. Accordingly, it is possible to reduce the variation in the discharge characteristics due to the difference in the inertance between the first nozzle and the second nozzle adjacent to each other.

It is preferable that the first opening portion of the first nozzle and the first opening portion of the second nozzle be line-symmetrically disposed, interposing an imaginary straight line along the first direction passing through the center of each of the second opening portions in the lengthwise direction, on both sides of the imaginary straight line in the lengthwise direction. According to the above-described configuration, since the two first nozzle and second nozzle in which the first opening portions are symmetrically disposed relative to the center of the second opening portion in the lengthwise direction on both sides in the lengthwise direction thereof have almost no difference in the inertance, it is thus possible to effectively reduce the variation in the discharge characteristics due to the difference in the inertance.

It is preferable that an arrangement of the plurality of nozzles be an arrangement in which the first nozzle and the second nozzle in which the first opening portions are line-symmetrically disposed are alternately disposed one by one every other nozzle. According to the above-described configuration, since the two first nozzle and second nozzle having almost no difference in the inertance are alternately disposed one by one every other nozzle, it is thus possible to reduce the variation in the discharge characteristics due to the difference in the inertance.

It is preferable that the first opening portions of the plurality of nozzles be disposed in a straight line shape intersecting with the first direction. According to the above-described configuration, since the first opening portions of the plurality of nozzles are disposed in the straight line shape intersecting with the first direction, in comparison with an arrangement in which the first opening portion is disposed at the center portion and the first opening portion is disposed at the endmost portion of the second opening portion in the lengthwise direction, the difference in the inertance between the nozzles adjacent to each other decreases, and it is thus possible to reduce the variation in the discharge characteristics.

It is preferable that the first opening portions of the plurality of nozzles be disposed in a curved line shape convex or concave in the second direction. According to the above-described configuration, since the first opening portions of the plurality of nozzles are disposed in a curved line shape of convex or concave in the second direction, in comparison with an arrangement in which the first opening portion is disposed at the center portion and the first opening portion is disposed at the endmost portion of the second opening portion in the lengthwise direction, the difference in the inertance between the nozzles adjacent to each other decreases, and it is thus possible to reduce the variation in the discharge characteristics.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
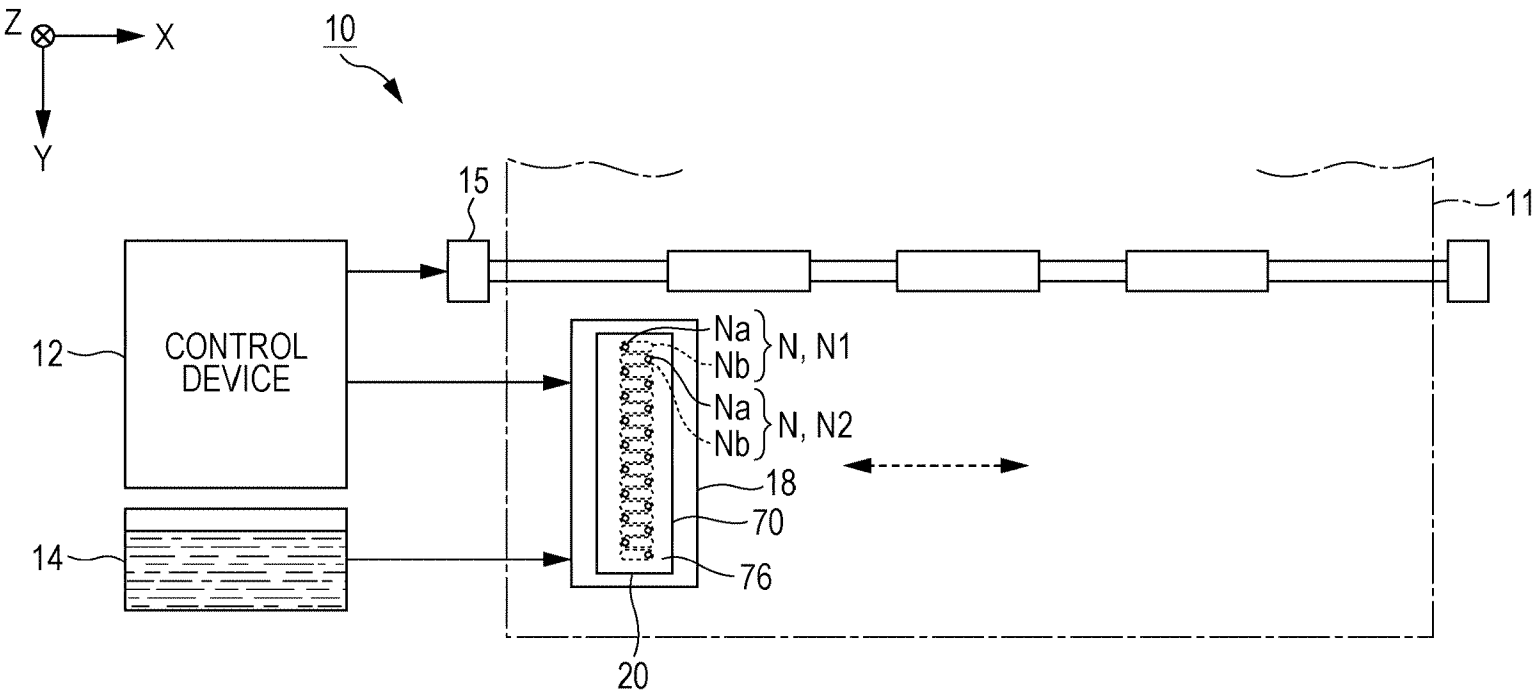
FIG. 1 is a configuration diagram of a liquid discharge apparatus according to a first embodiment of the invention.

FIG. 1 is a partial configuration diagram of a liquid discharge apparatus 10 according to a first embodiment of the invention. The liquid discharge apparatus 10 of the first embodiment is an ink jet type printing apparatus which discharges ink as an example of liquid to a medium 11 such as printing paper or the like. The liquid discharge apparatus 10 illustrated in FIG. 1 includes a control device 12, a transport mechanism 15, a carriage 18, and a liquid discharge head 20. A liquid container 14 which holds the ink is mounted to the liquid discharge apparatus 10.

The liquid container 14 is an ink tank type cartridge formed of a box-shaped container which is detachable to the main body of the liquid discharge apparatus 10. Note that, the liquid container 14 is not limited to a box-shaped container, may be an ink pack type cartridge formed from a bag-shaped container. The liquid container 14 holds the ink. The ink may be a black ink, or may be a color ink. The ink held in the liquid container 14 is sent by pressure to the liquid discharge head 20 by a pump (not illustrated).

The control device 12 generally controls each element of the liquid discharge apparatus 10. The transport mechanism 15 transports the medium 11 in a Y direction under the control of the control device 12. The liquid discharge head 20 discharges the ink supplied from the liquid container 14 to the medium 11 through each of a plurality of nozzles N under the control of the control device 12. The liquid discharge head 20 includes a liquid discharge portion 70. The liquid discharge portion 70 has a nozzle plate 76 opposing the medium 11. The plurality of nozzles N are formed in the nozzle plate 76.

The liquid discharge head 20 is mounted on the carriage 18. The control device 12 reciprocates the carriage 18 in an X direction intersecting with (in FIG. 1, orthogonal to) the Y direction. By the liquid discharge head 20 discharging the ink to the medium 11 in parallel with repetition of transportation of the medium 11 and reciprocation of the carriage 18, a desired image is formed on a surface of the medium 11. Note that, a plurality of the liquid discharge heads 20 may be mounted on the carriage 18. A direction perpendicular to an X-Y plane (a plane parallel with the surface of the medium 11) is expressed as a Z direction. In the first embodiment, the Y direction corresponds to a first direction, the X direction corresponds to a second direction.

Liquid Discharge Head

Figure 2:
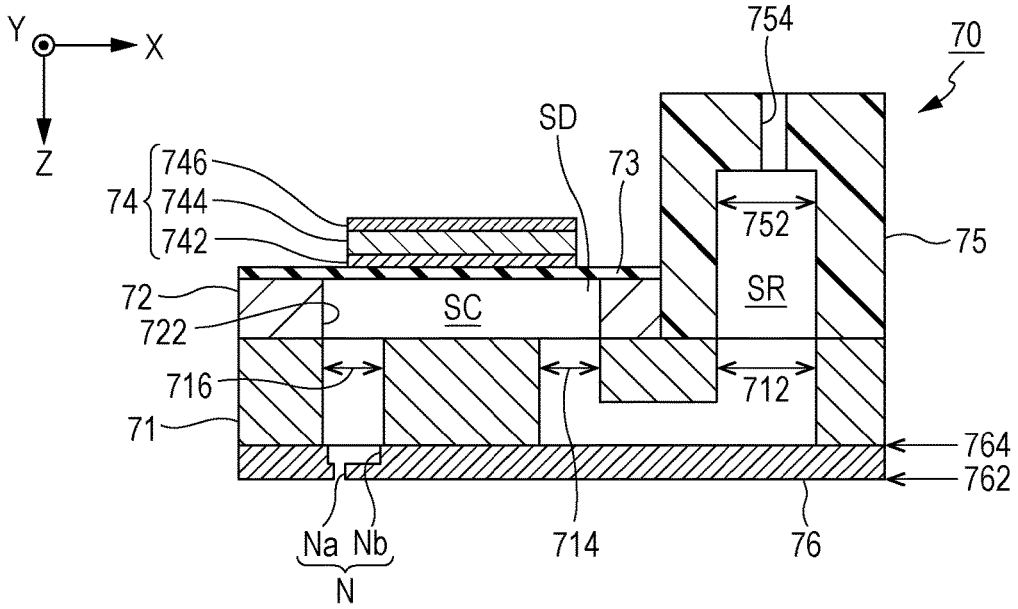
FIG. 2 is a cross-sectional view of a liquid discharge portion.

FIG. 2 is a cross-sectional view of the liquid discharge portion 70 focusing on arbitrary one nozzle N. As illustrated in FIG. 2, the liquid discharge portion 70 is a structural body in which a pressure chamber substrate 72, a vibration plate 73, a piezoelectric element 74, and a support body 75 are disposed on one side of a flow path substrate 71 and the nozzle plate 76 is disposed on the other side. The flow path substrate 71, the pressure chamber substrate 72, and the nozzle plate 76 are, for example, formed by a silicon plate material, and the support body 75 is, for example, formed by injection molding of a resin material. The plurality of nozzles N are formed in the nozzle plate 76.

In the flow path substrate 71, an opening portion 712, a branch flow path 714, and a communication flow path 716 are formed. The branch flow path 714 and the communication flow path 716 are through-holes which are formed for each of the nozzles N, the opening portion 712 is a continuous opening across the plurality of nozzles N. A space in which a storage portion (recess portion) 752 formed in the support body 75 and the opening portion 712 in the flow path substrate 71 communicate with each other functions as a common liquid chamber (reservoir) SR that holds the ink supplied from the liquid container 14 through an introduction flow path 754 of the support body 75.

In the pressure chamber substrate 72, an opening portion 722 is formed for each of the nozzles N. The vibration plate 73 is an elastically deformable plate material installed on a surface of the pressure chamber substrate 72 on an opposite side from the flow path substrate 71. A space interposed between the vibration plate 73 and the flow path substrate 71 in the inside of each of the opening portions 722 of the pressure chamber substrates 72 functions as a pressure chamber (cavity) SC which is filled with the ink supplied from the common liquid chamber SR through the branch flow path 714. Each of the pressure chambers SC communicates with the nozzle N via the communication flow path 716 of the flow path substrate 71. A space configured by the pressure chamber SC and the common liquid chamber SR, the opening portion 712 and the branch flow path 714 communicating the chambers, and the communication flow path 716 configures an internal space SD of the liquid discharge head 20.

The piezoelectric element 74 is formed on a surface of the vibration plate 73 on an opposite side from the pressure chamber substrate 72 for each of the nozzles N. Each of the piezoelectric elements 74 is a driving element (pressure generating element) in which a piezoelectric body 744 is interposed between a first electrode 742 and a second electrode 746. A driving signal is supplied to one of the first electrode 742 and the second electrode 746, and a predetermined reference potential is supplied to the other. When the vibration plate 73 vibrates by the piezoelectric element 74 being deformed by the driving signal being supplied, pressure in the pressure chamber SC varies and the ink in the pressure chamber SC is discharged through the nozzle N. Specifically, the ink of a discharge amount corresponding to an amplitude of the driving signal is discharged through the nozzle N. Note that, the configuration of the piezoelectric element 74 is not limited to that described above.

As illustrated in FIG. 1 and FIG. 2, each of the nozzles N formed in the nozzle plate 76 of the first embodiment is formed of a first opening portion Na and a second opening portion Nb communicating with each other. Hereinafter, among the plurality of nozzles N, arbitrary two nozzles N adjacent to each other are referred to as a first nozzle N1 and a second nozzle N2. The nozzle plate 76 is a plate material including a first surface 762 and a second surface 764 on an opposite side from the first surface 762. The first surface 762 is a plane on a discharge side from which the ink is discharged, the second surface 764 is a plane on the pressure chamber SC side.

Figure 3A:
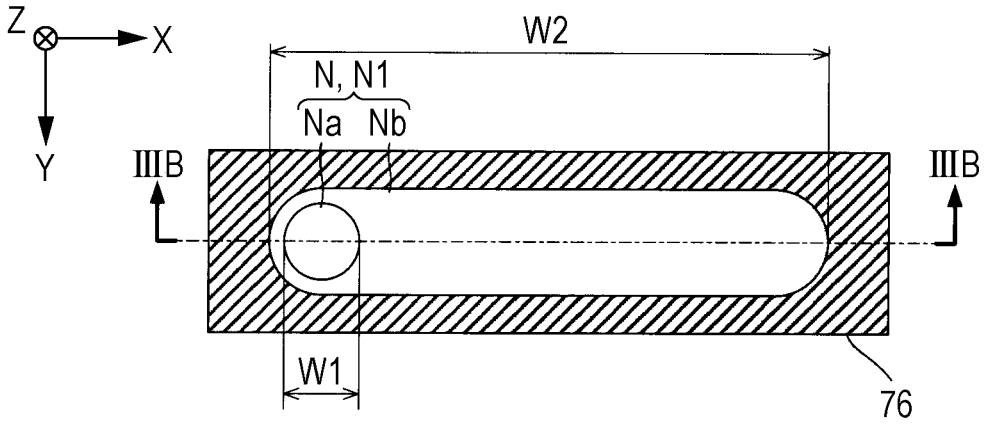
FIG. 3A is an enlarged view of a first nozzle of a nozzle plate, viewed from a pressure chamber side.
Figure 3B:
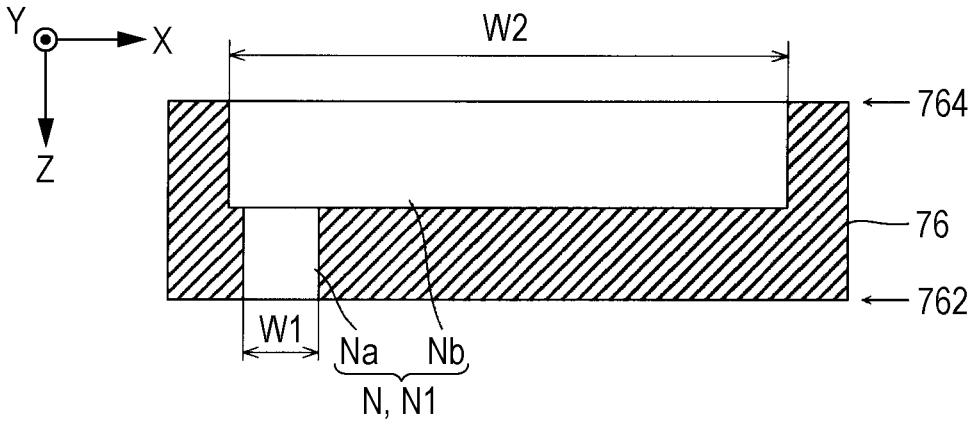
FIG. 3B is a cross-sectional view taken along a line IIIB-IIIB in FIG. 3A.

FIG. 3A is an enlarged view of the first nozzle N1 in the nozzle plate 76, viewed from the pressure chamber SC side. FIG. 3B is a cross-sectional view taken along a line IIIB-IIIB in FIG. 3A. As illustrated in FIG. 3A, the first opening portion Na of each of the nozzles N is a cylindrical opening. The second opening portion Nb is an opening having a long circular shape extending in the X direction, an inner diameter W2 thereof in the X direction is larger than an inner diameter W1 of the first opening portion Na. As illustrated in FIG. 3B, the first opening portion Na opens toward the first surface 762 on an ink discharge side, the second opening portion Nb opens toward the second surface 764 on the pressure chamber SC side. The first nozzle N1 has an arrangement in which the first opening portion Na is disposed at an endmost portion of the second opening portion Nb in a lengthwise direction on the negative side in the X direction. On the other hand, the second nozzle N2 illustrated in FIG. 1 has an arrangement in which the first opening portion Na is disposed at an endmost portion of the second opening portion Nb in the lengthwise direction on the positive side in the X direction (the endmost portion on an opposite side from the first nozzle N1). As illustrated in FIG. 1, in the liquid discharge head 20 of the first embodiment, the arrangement such as the first nozzle N1 and the arrangement such as the second nozzle N2 are alternately arranged on a straight line along the Y direction.

Incidentally, if only the first opening portions Na are linearly disposed at a high density, for example, a disposition interval between the first opening portions Na of the first nozzle N1 and the second nozzle N2 through which the ink is discharged becomes short. Accordingly, for example, since a liquid droplet of the ink discharged through the first opening portion Na of the first nozzle N1 is easily affected by a vortex flow generated in accordance with ink discharged through the first opening portion Na of the other second nozzle N2 or self-jet, there is a risk that a landing position to the medium 11 shifts and a wind ripple or the like occurs. On the other hand, if the nozzles including the second opening portion Nb are arranged in a staggered shape as a whole, a disposition density of the nozzles N can be reduced, but, depending on positions of the first opening portion Na and the second opening portion Nb, discharge characteristics of the nozzle are largely affected, and there is a risk that variation in the discharge characteristics occurs.

Figure 4:
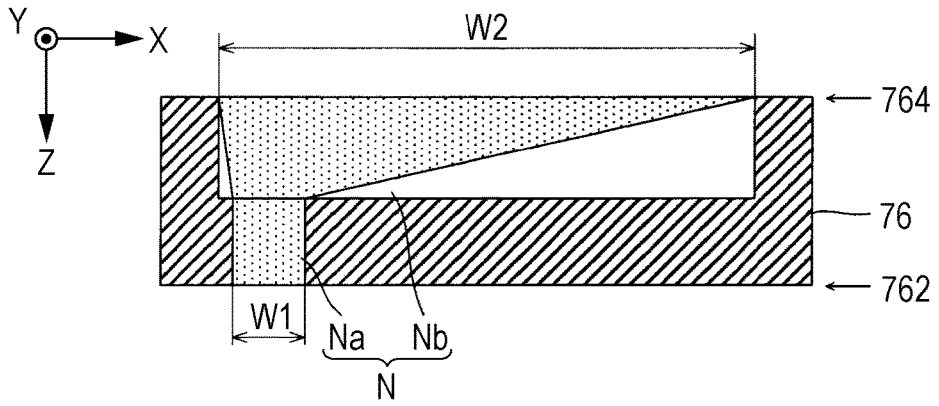
FIG. 4 is a cross-sectional view illustrating a flow in a case where a first opening portion is located at the center portion of the second opening portion.
Figure 5:
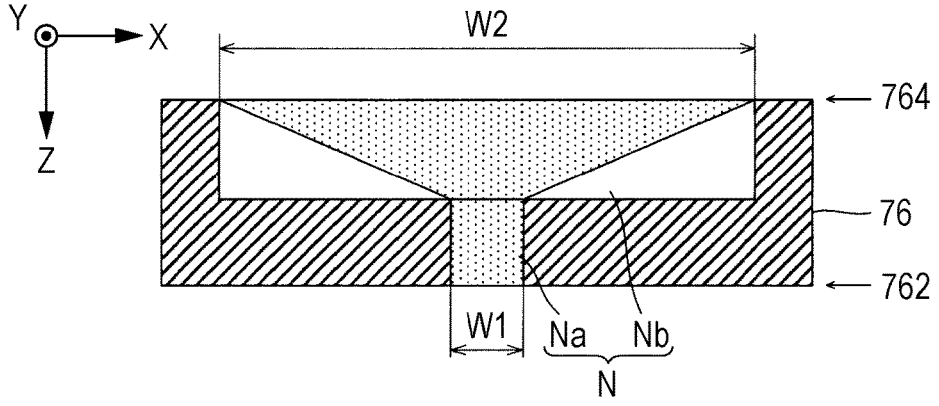
FIG. 5 is a cross-sectional view illustrating a flow in a case where the first opening portion is located at an endmost portion of the second opening portion.

Hereinafter, the position of the first opening portion Na with respect to the second opening portion Nb and the discharge characteristics of the nozzle N will be described in detail. Here, as the discharge characteristics of the nozzle N, a natural vibration period Tc of the pressure chamber SC and an ink liquid droplet rate Vm are described as an example. FIG. 4 and FIG. 5 are cross-sectional views illustrating a difference between flows of the ink due to a difference between positions of the first opening portions Na with respect to the second opening portions Nb. FIG. 4 illustrates a case where the first opening portion Na is disposed at the endmost portion of the second opening portion Nb on the negative side in the lengthwise direction (the X direction), FIG. 5 illustrates a case where the first opening portion Na is disposed at the center portion of the second opening portion Nb in the lengthwise direction.

Figure 6:
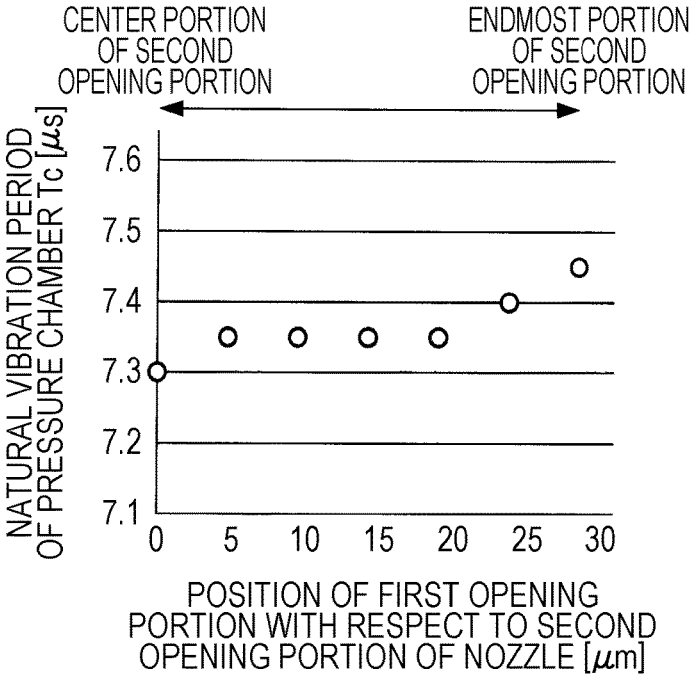
FIG. 6 is a diagram illustrating, by a graph, a relationship between a position of the first opening portion and a natural vibration period of the pressure chamber.
Figure 7:
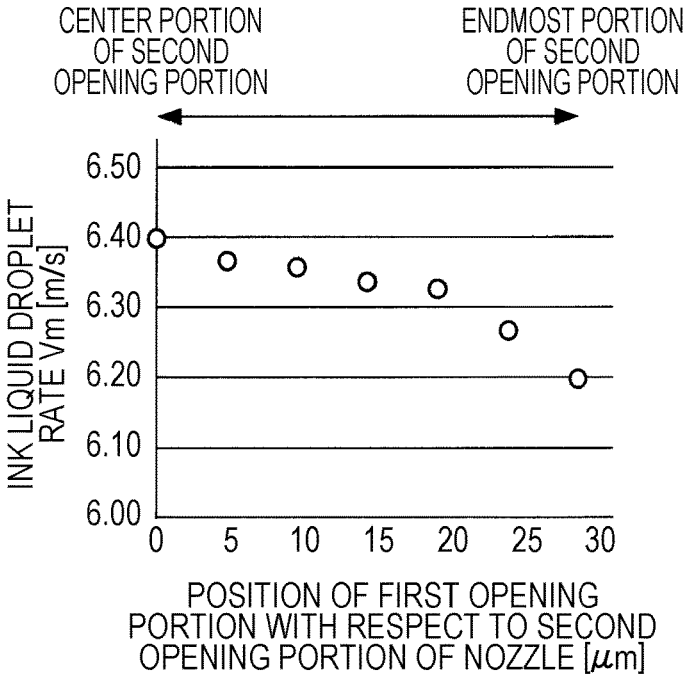
FIG. 7 is a diagram illustrating, by a graph, a relationship between the position of the first opening portion and an ink liquid droplet rate.

FIG. 6 is a diagram illustrating, by a graph, a relationship between the position of the first opening portion Na with respect to the second opening portion Nb and the natural vibration period Tc [m/s] of the pressure chamber SC. FIG. 7 is a diagram illustrating, by a graph, a relationship between the position of the first opening portion Na with respect to the second opening portion Nb and the ink liquid droplet rate Vm [m/s]. A horizontal axis of FIG. 6 and FIG. 7 represents the position of the first opening portion Na from the center of the second opening portion Nb. The natural vibration period Tc in FIG. 6 is expressed by the following Formula (1), when inertance is represented by M, compliance is represented by C. The ink liquid droplet rate Vm in FIG. 7 is expressed by the following Formula (2), when K represents a coefficient, A represents a cross-sectional area of the first opening portion Na, and Q represents an ink flow amount.

$$Tc=2\pi\cdot(MC)^{1/2} \quad (1)$$

$$Vm=(K\cdot\pi^2\cdot Q)/Tc\cdot A \quad (2)$$

There is a difference in the ink flow flowing from the second opening portion Nb to the first opening portion Na, between a case where the first opening portion Na is disposed at the position (endmost portion) of FIG. 4 and a case where the first opening portion Na is disposed at the position (center portion) of FIG. 5, and therefore there is a difference in the inertance M. As shown in the above-described Formula (1) and FIG. 6, since the natural vibration period Tc of the pressure chamber SC increases as the inertance M increases, as shown in the above-described Formula (2) and FIG. 7, the ink liquid droplet rate Vm lowers.

As described above, it can be seen that, in accordance with the position of the first opening portion Na with respect to the second opening portion Nb, the discharge characteristics of the nozzle N such as the natural vibration period Tc of the pressure chamber SC, the ink liquid droplet rate Vm, or the like will change.

Accordingly, depending on the positions of the first opening portion Na and the second opening portion Nb, the discharge characteristics of the nozzle are largely affected, and there is a risk that the variation in the discharge characteristics may occur. Conversely, if the position of the first opening portion Na with respect to the second opening portion Nb is changed such that the variation in the discharge characteristics does not occur, even if the nozzle N is disposed in the staggered shape, it is possible to suppress an influence on the discharge characteristics of the nozzle.

Accordingly, in the first embodiment, using the change in the discharge characteristics of the nozzle N in accordance with the position of the first opening portion Na with respect to the second opening portion Nb, the first opening portion Na and the second opening portion Nb are arranged so as to also suppress the variation in the discharge characteristics.

Figure 8:
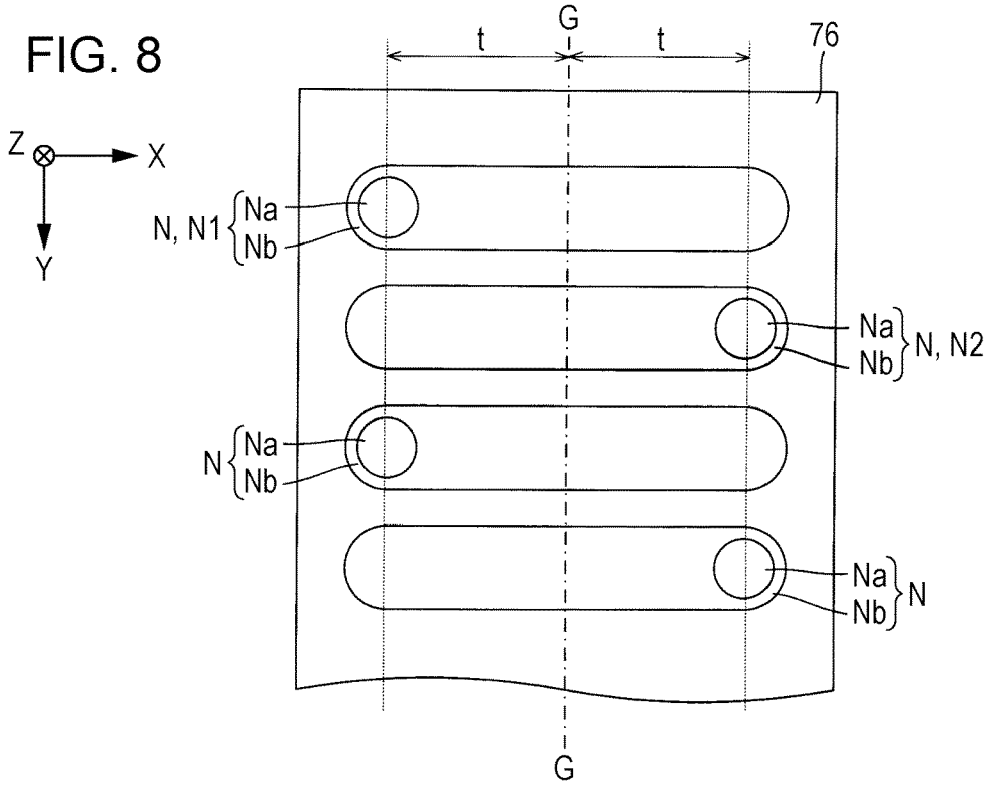
FIG. 8 is a plan view illustrating an arrangement of the nozzles in the nozzle plate.

Specifically, for example, as illustrated in FIG. 8, in the first embodiment, in arbitrary first nozzle N1 and second nozzle N2 adjacent to each other among the plurality of nozzles N, the second opening portions Nb are linearly disposed along the Y direction, the first opening portions Na are disposed so as to be shifted in the X direction. In other words, the second opening portions Nb of the plurality of nozzles N are linearly disposed along the Y direction, the first opening portions Na of the plurality of nozzles N are disposed so as to be shifted in the X direction. Each of the plurality of second opening portions Nb is disposed below (Z direction) each of the plurality of pressure chambers SC. In other words, a direction in which the plurality of second opening portions Nb are arranged and a direction in which the plurality of pressure chambers SC are arranged are both the Y direction.

According to such a configuration, in comparison with a case where not only the first opening portions Na but also the second opening portions Nb are shifted in the X direction, the variation in the discharge characteristics of the nozzle N can be suppressed even in a disposition of the staggered shape. Furthermore, the first opening portions Na can be disposed in the staggered shape by being disposed so as to be shifted in the X direction, the liquid droplet of the ink discharged through each of the nozzles N is less affected by the vortex flow. Accordingly, it is possible to suppress a shift of the landing position of the liquid droplet of the ink to the medium 11, and it is thus possible to suppress generation of the wind ripple or the like. As described above, according to the configuration of the first embodiment, while reducing the variation in the discharge characteristics of the nozzle N, it is possible to suppress the shift of the landing position of the liquid droplet to the medium 11.

In the configuration in FIG. 8, one and the other first opening portions Na of the first nozzle N1 and the second nozzle N2 adjacent to each other are line-symmetrically disposed, interposing an imaginary straight line G-G along the Y direction passing through the center O of the second opening portion Nb in the lengthwise direction, on both sides of the line in the lengthwise direction. According to such a configuration, the two nozzles N1 and N2 in which the first opening portions Na are symmetrically disposed relative to the center O of the second opening portion Nb in the lengthwise direction on both sides in the lengthwise direction do not have a difference in the inertance M. In other words, even on the left side or the right side relative to the center O of the second opening portion Nb in the lengthwise direction, the arrangements with the same distance t from the center O to the first opening portion Na have the same inertance M. Accordingly, it is possible to effectively reduce the variation in the discharge characteristics.

FIG. 8 illustrates the configuration in which the first nozzle N1 in which the first opening portion Na is disposed at the endmost portion of the second opening portion Nb on the left side in the lengthwise direction (the negative side in the X direction) and the second nozzle N2 in which the first opening portion Na is disposed at the endmost portion of the second opening portion Nb on the right side in the lengthwise direction (the positive side in the X direction) are alternately disposed in the Y direction. Accordingly, the first opening portions Na of the two adjacent nozzles N are distanced in the right and left to the maximum, and less affected by the vortex flow generated in accordance with the discharge of the ink or the self-jet, and the maximum effect for suppressing the shift of the landing position to the medium 11 is obtained.

Note that, in accordance with the change in the inertance M, the natural vibration period Tc of the pressure chamber SC in FIG. 6 and the ink liquid droplet rate Vm in FIG. 7 do not change so much when the distance from the center (0 μm) of the second opening portion Nb to the first opening portion Na is within about 20 μm. However, a large change appears when the distance exceeds 20 μm, and thereafter, as the distance from the center (0 μm) of the second opening portion Nb to the first opening portion Na increases, the change increases. Accordingly, the difference in the inertance M between a case where the first opening portion Na is disposed at the center portion (FIG. 4) and a case where the first opening portion Na is disposed at the endmost portion (FIG. 5) of the second opening portion Nb in the lengthwise direction is maximized.

Accordingly, the arrangement of the first opening portion Na of the first nozzle N1 and the first opening portion Na of the second nozzle N2 adjacent to each other does not include an arrangement in which the first opening portion Na is disposed at the center portion and the first opening portion Na is disposed at the endmost portion of the second opening portion Nb in the lengthwise direction (for example, a combination of the nozzles in FIG. 4 and FIG. 5), in other words, does not include an arrangement in which the difference in the inertance M is maximized, which makes it possible to reduce the variation in the discharge characteristics due to the difference in the inertance M between the first nozzle N1 and the second nozzle N2.

First Variation on First Embodiment

Figure 9:
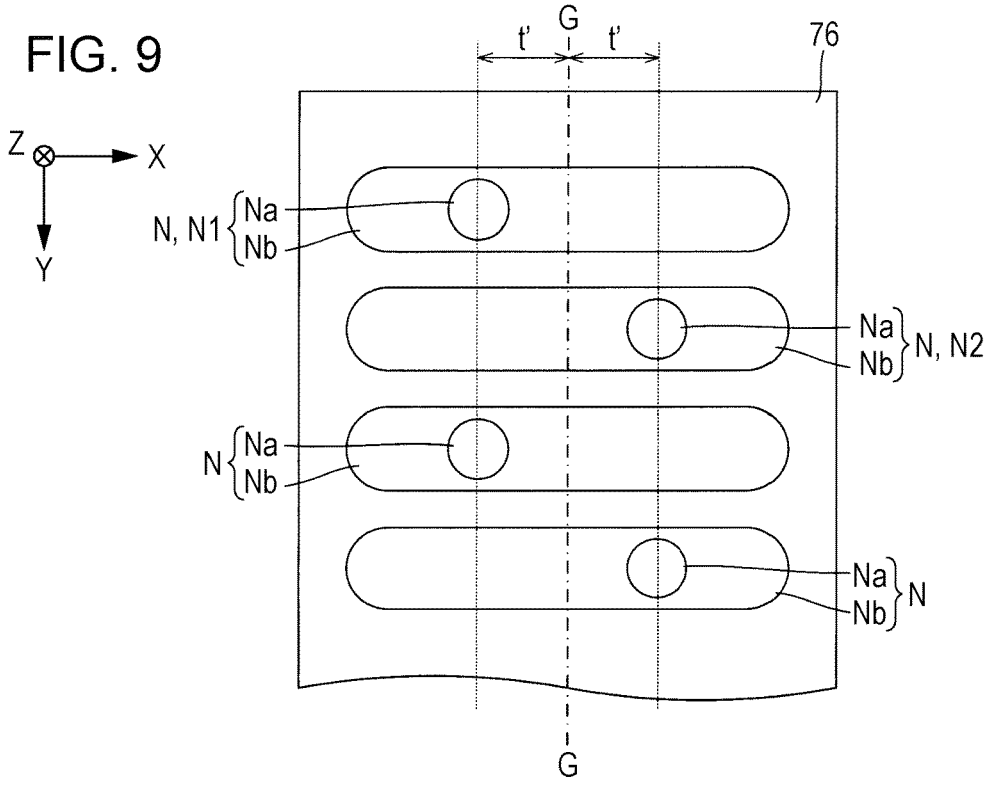
FIG. 9 is a plan view illustrating an arrangement of the nozzles in a first variation.

FIG. 9 is a plan view illustrating an arrangement of the nozzles N in the nozzle plate 76 according to a first variation on the first embodiment, and corresponds to FIG. 8. In each variation described below as an example, elements having the same actions and functions are given the reference numerals used in the description in FIG. 1 to FIG. 8, and detailed descriptions thereof will be appropriately omitted. FIG. 9 illustrates the configuration in which a distance t' from the center O of the second opening portion Nb in the lengthwise direction to the first opening portion Na is shortened than the distance t in FIG. 8. By the configuration in FIG. 9 as well, the first opening portions Na are disposed so as to have the same inertance M, it is thus possible to effectively reduce the variation in the discharge characteristics.

Second Variation on First Embodiment

Figure 10:
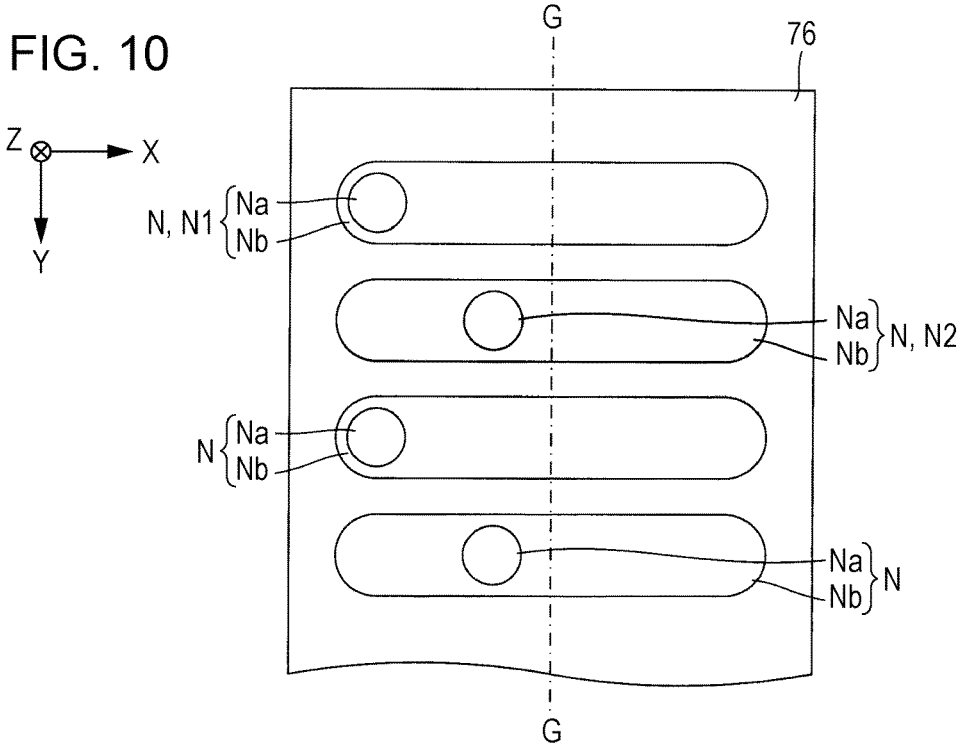
FIG. 10 is a plan view illustrating an arrangement of the nozzles in a second variation.

FIG. 10 is a plan view illustrating an arrangement of the nozzles N in the nozzle plate 76 according to a second variation on the first embodiment. FIG. 10 illustrates the configuration in which the first opening portion Na of the first nozzle N1 and the first opening portion Na of the second nozzle N2 are biased on the left side (the negative side in the X direction) relative to the imaginary straight line G-G passing through the center O of the second opening portion Nb in the lengthwise direction.

According to the configuration in FIG. 10, the first opening portions Na of the respective nozzles N can be disposed in the staggered shape. In addition, in comparison with the arrangement in which the first opening portion Na is disposed at the center portion and the first opening portion Na is disposed at the endmost portion of the second opening portion Nb in the lengthwise direction (for example, the combination of the nozzles in FIG. 4 and FIG. 5), the difference in the inertance M between the first nozzle N1 and the second nozzle N2 adjacent to each other decreases, it is thus possible to reduce the variation in the discharge characteristics even in a disposition of the staggered shape. In the configuration in FIG. 10 as well, in the same manner as the configuration in FIG. 8, the second opening portions Nb are linearly disposed along the Y direction, and the first opening portions Na are disposed so as to be shifted in the X direction. Accordingly, by the configuration in FIG. 10 as well, while reducing the variation in the discharge characteristics of the nozzle N, it is possible to suppress the shift of the landing position of the liquid droplet to the medium 11. Note that, the first opening portion Na may be biased on the right side (the positive side in the X direction) relative to the imaginary straight line G-G.

Third Variation on First Embodiment

Figure 11:
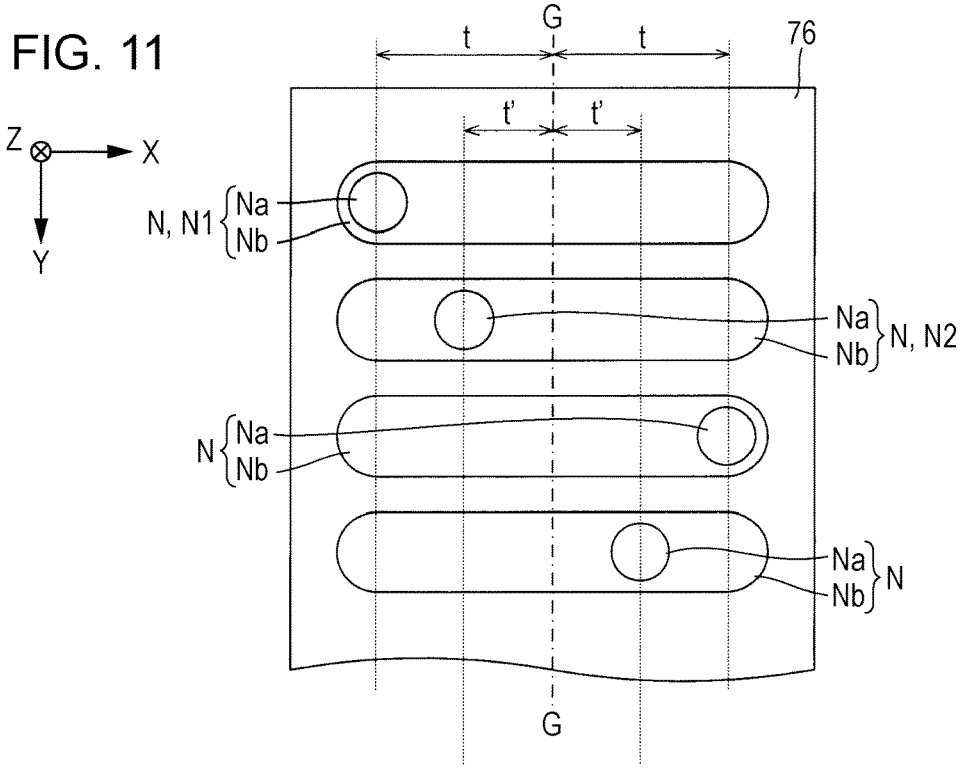
FIG. 11 is a plan view illustrating an arrangement of the nozzles in a third variation.

FIG. 11 is a plan view illustrating an arrangement of the nozzles N in the nozzle plate 76 according to a third variation on the first embodiment. The arrangement of the plurality of nozzles N in FIG. 11 is an arrangement in which the first nozzle N1 and the second nozzle N2 in which the first opening portions Na are line-symmetrically disposed are alternately disposed one by one relative to the imaginary straight line G-G line every other nozzle N. Specifically, in FIG. 11, when arbitrary four nozzles N continuously arranged from above to below are assumed to be a nozzle N(1) of the first, a nozzle N(2) of the second, a nozzle N(3) of the third, and a nozzle N(4) of the fourth, as for the nozzle N(1) of the first and the nozzle N(3) of the third, the first opening portions Na are line-symmetrically disposed relative to the imaginary straight line G-G line. Additionally, as for the nozzle N(2) of the second and the nozzle N(4) of the fourth, the first opening portions Na are line-symmetrically disposed relative to the imaginary straight line G-G line.

The nozzle N(1) of the first and the nozzle N(3) of the third have the same distance t from the imaginary straight line G-G to each of the first opening portions Na. Additionally, the nozzle N(2) of the second and the nozzle N(4) of the fourth have the same distance t' from the imaginary straight line G-G to each of the first opening portions Na. Since the distance t and the distance t' are different from each other, the nozzle N(1) of the first and the nozzle N(2) of the second have the different distances from the imaginary straight line G-G to each of the first opening portions Na, the nozzle N(3) of the third and the nozzle N(4) of the fourth also have the different distances from the imaginary straight line G-G to each of the first opening portions Na.

According to such a configuration in FIG. 11, the first opening portions Na of the respective nozzles N can be disposed in the staggered shape. Furthermore, in comparison with the arrangement in which the first opening portion Na is disposed at the center portion and the first opening portion Na is disposed at the endmost portion of the second opening portion Nb in the lengthwise direction (for example, the combination of the nozzles in FIG. 4 and FIG. 5), the difference in the inertance M between the first nozzle N1 and the second nozzle N2 adjacent to each other decreases, it is thus possible to reduce the variation in the discharge characteristics even in a disposition of the staggered shape. In the configuration in FIG. 11 as well, in the same manner as the configuration in FIG. 8, the second opening portions Nb are linearly disposed along the Y direction, and the first opening portions Na are disposed so as to be shifted in the X direction. Accordingly, by the configuration in FIG. 11 as well, while reducing the variation in the discharge characteristics of the nozzle N, it is possible to suppress the shift of the landing position of the liquid droplet to the medium 11.

Fourth Variation on First Embodiment

Figure 12:
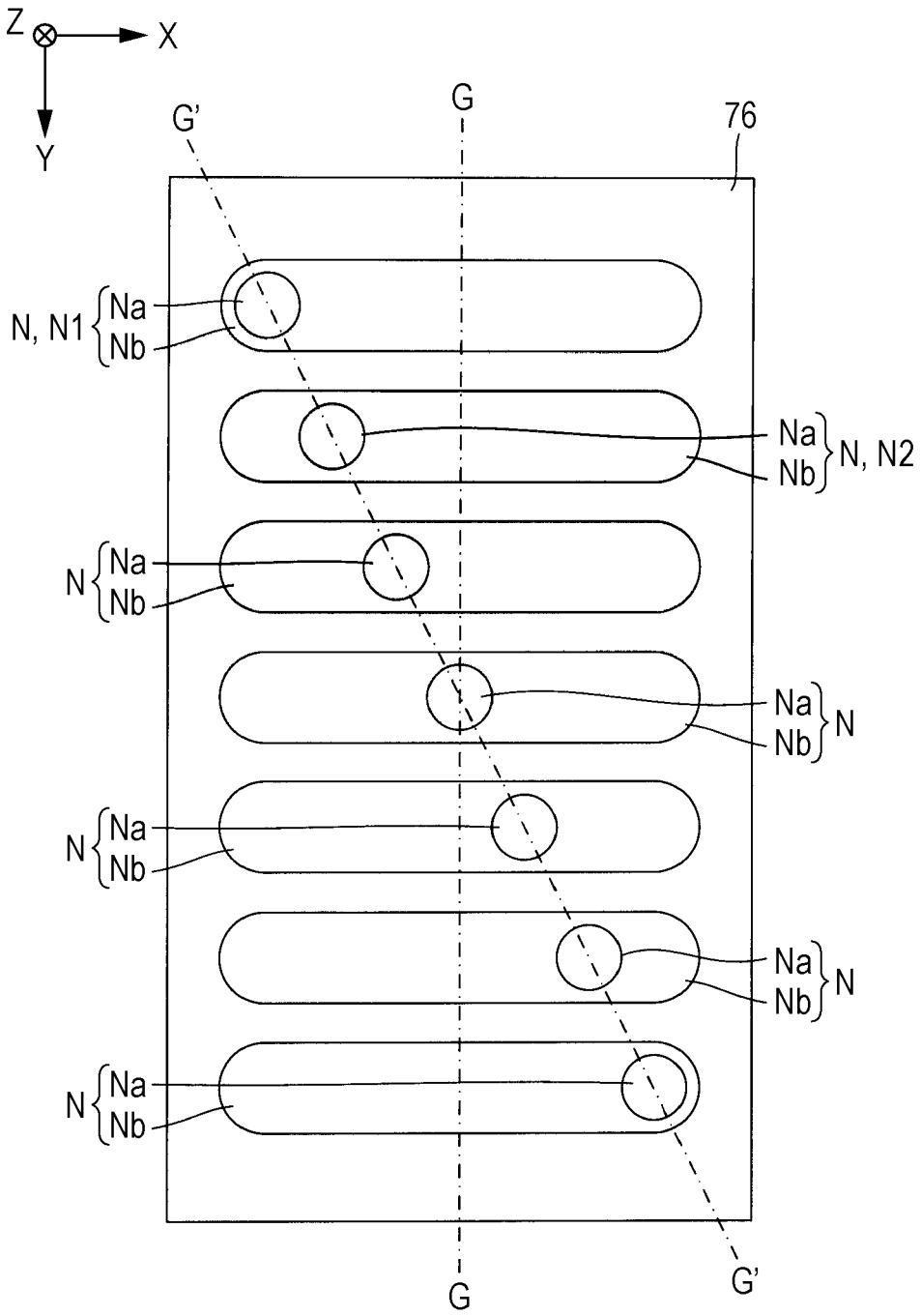
FIG. 12 is a plan view illustrating an arrangement of the nozzles in a fourth variation.

FIG. 12 is a plan view illustrating an arrangement of the nozzles N in the nozzle plate 76 according to a fourth variation on the first embodiment. As illustrated in FIG. 12, the first opening portions Na may be disposed so as to overlap with an imaginary straight line G'-G' intersecting with the Y direction which is an arrangement direction of the second opening portions Nb. In the configuration in FIG. 12, since the first opening portions Na of the plurality of nozzles N are disposed in a straight line shape intersecting with the Y direction, in comparison with the arrangement in which the first opening portion Na is disposed at the center portion and the first opening portion Na is disposed at the endmost portion of the second opening portion Nb in the lengthwise direction (for example, the combination of the nozzles in FIG. 4 and FIG. 5), the difference in the inertance M between the nozzles N adjacent to each other decreases, it is thus possible to reduce the variation in the discharge characteristics. In the configuration in FIG. 12 as well, in the same manner as the configuration in FIG. 8, the second opening portions Nb are linearly disposed along the Y direction, and the first opening portions Na are disposed so as to be shifted in the X direction. Accordingly, by the configuration in FIG. 12 as well, while reducing the variation in the discharge characteristics of the nozzle N, it is possible to suppress the shift of the landing position of the liquid droplet to the medium 11.

Fifth Variation on First Embodiment

Figure 13:
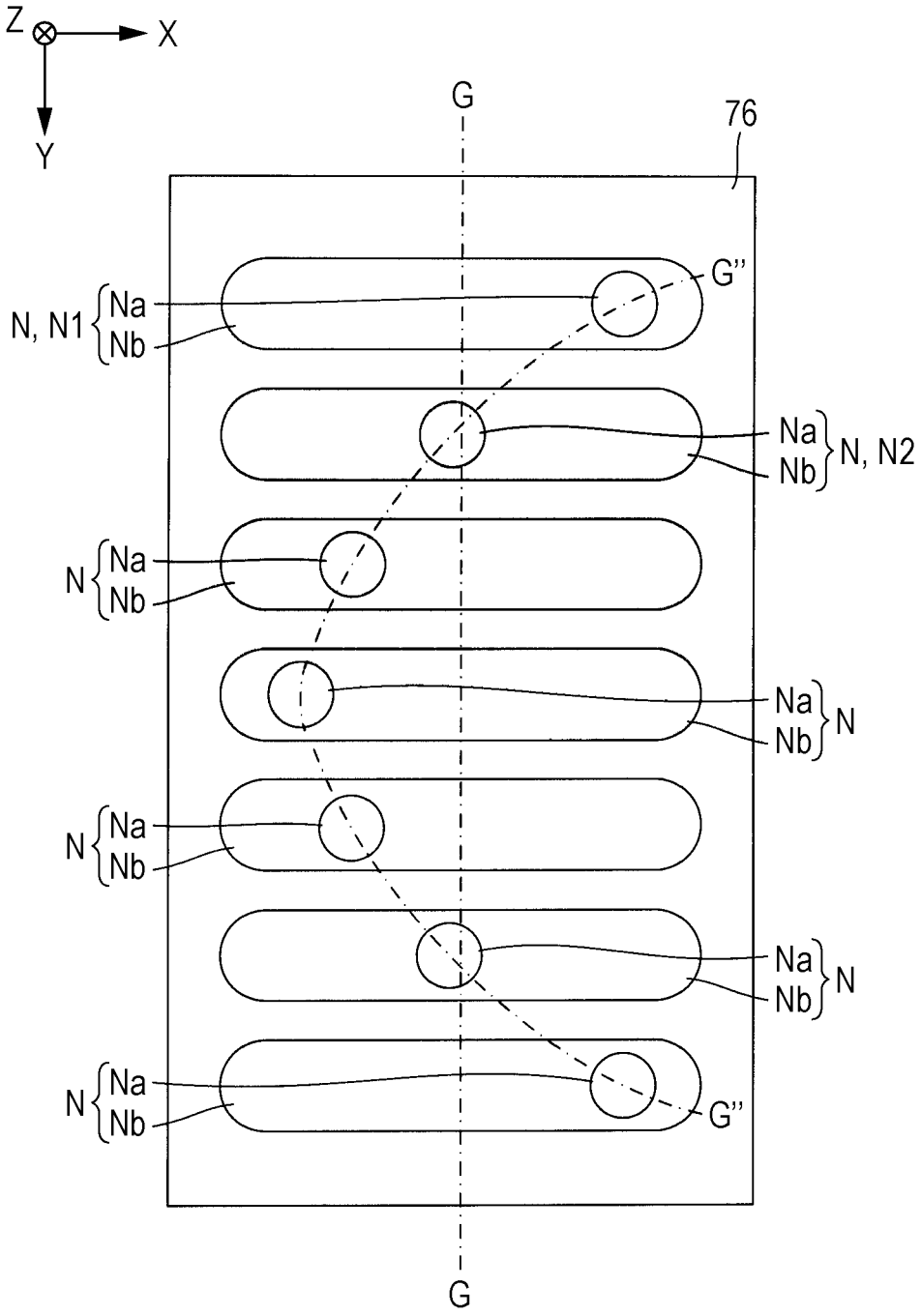
FIG. 13 is a plan view illustrating an arrangement of the nozzles in a fifth variation.

FIG. 13 is a plan view illustrating an arrangement of the nozzles N in the nozzle plate 76 according to a fifth variation on the first embodiment. As illustrated in FIG. 13, the first opening portions Na may be disposed so as to overlap with an imaginary curved line G"-G" convex in the X direction. According to the configuration in FIG. 13, since the first opening portions Na of the plurality of nozzles N are disposed in a curved line shape of convex in the X direction, in comparison with the arrangement in which the first opening portion Na is disposed at the center portion and the first opening portion Na is disposed at the endmost portion of the second opening portion Nb in the lengthwise direction (for example, the combination of the nozzles in FIG. 4 and FIG. 5), the difference in the inertance M between the nozzles N adjacent to each other decreases, it is thus possible to reduce the variation in the discharge characteristics. Additionally, in the configuration in FIG. 13 as well, in the same manner as the configuration in FIG. 8, the second opening portions Nb are linearly disposed along the Y direction, and the first opening portions Na are disposed so as to be shifted in the X direction. Accordingly, by the configuration in FIG. 13 as well, while reducing the variation in the discharge characteristics of the nozzle N, it is possible to suppress the shift of the landing position of the liquid droplet to the medium 11. Note that, the first opening portions Na of the plurality of nozzles N may be disposed in a curved line shape of concave in the X direction.

Second Embodiment

A second embodiment of the invention will be described. In each mode described as an example below, the elements whose actions and functions are the same as those in the first embodiment are given the reference numerals used in the description in the first embodiment, and detailed descriptions thereof will be appropriately omitted. Although the first embodiment describes the liquid discharge apparatus 10 including a serial head in which the carriage 18 on which the liquid discharge head 20 is mounted moves in the X direction as an example, the second embodiment describes the liquid discharge apparatus 10 including the liquid discharge head 20 configured as a line head long in a direction intersecting with the transport direction of the medium 11 (the X direction herein) as an example.

Figure 14:
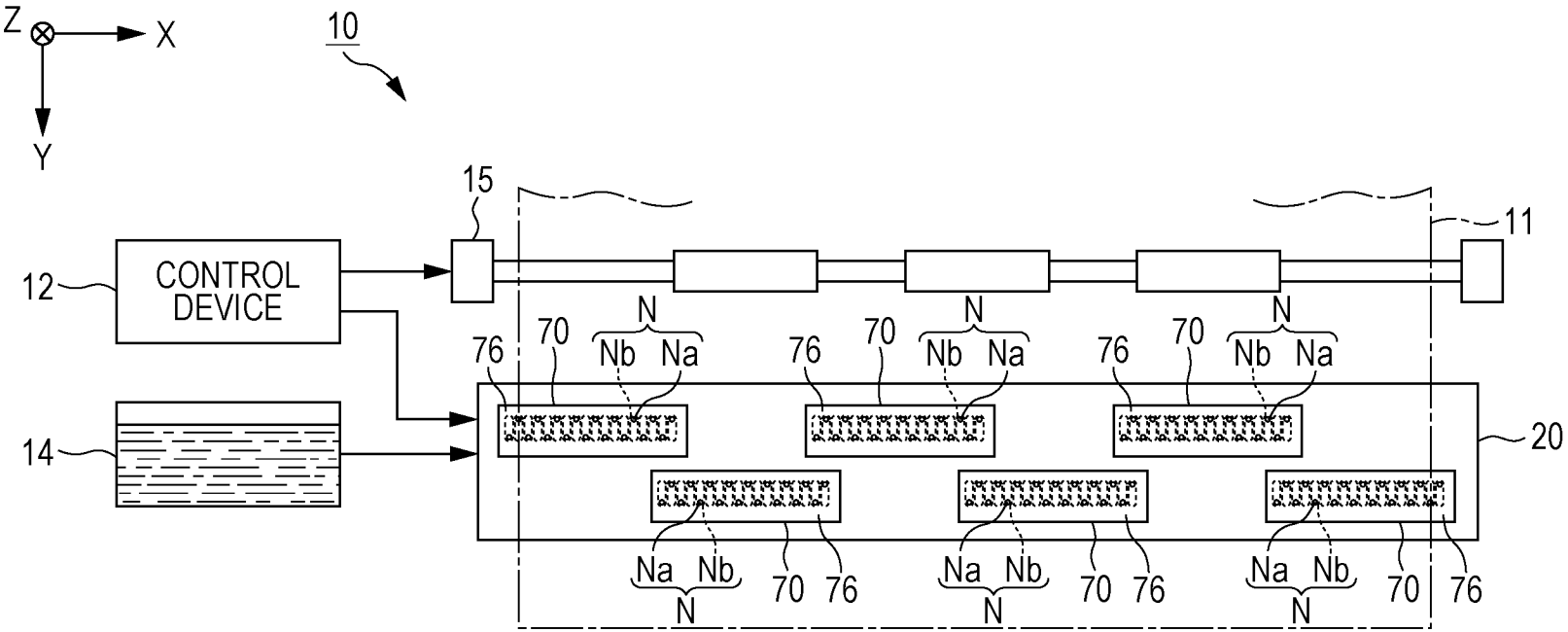
FIG. 14 is a configuration diagram of a liquid discharge apparatus according to a second embodiment of the invention.
Figure 15:
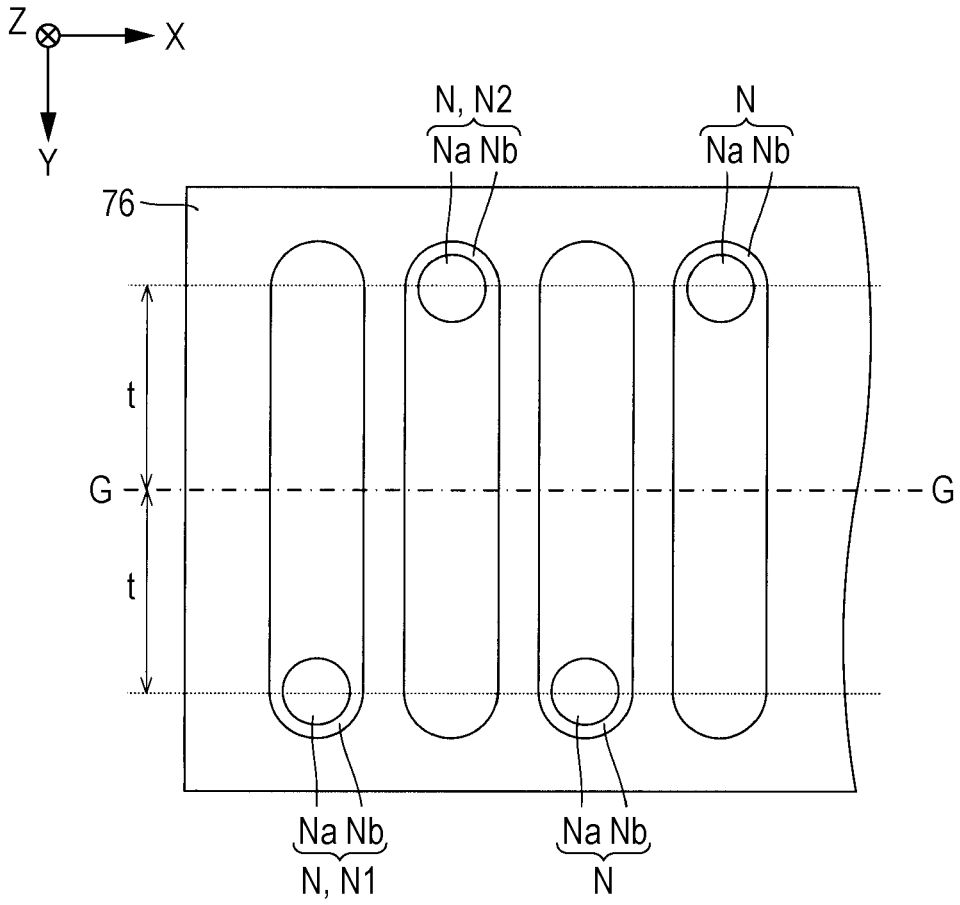
FIG. 15 is a plan view illustrating an arrangement of the nozzles in the second embodiment.

FIG. 14 is a partial configuration diagram of the liquid discharge apparatus 10 according to the second embodiment. FIG. 15 is a plan view illustrating an arrangement of the nozzles N in the nozzle plate 76 in the liquid discharge head 20 in FIG. 14. The liquid discharge head 20 in FIG. 14 is the line head long in the X direction. In the liquid discharge head 20, a plurality of the liquid discharge portions 70 are disposed in the staggered shape in the X direction.

In the second embodiment, unlike the first embodiment, the X direction corresponds to the first direction, and the Y direction corresponds to the second direction. FIG. 15 corresponds to a diagram in which the nozzle plate in FIG. 8 is rotated in the counterclockwise direction by 90°. In other words, in the first nozzle N1 and the second nozzle N2 adjacent to each other, the second opening portions Nb are linearly disposed along the X direction, the first opening portions Na are disposed so as to be shifted in the Y direction. Note that, FIG. 15 may be a diagram in which the nozzle plate in FIG. 8 is rotated in the clockwise direction by 90°.

According to the configuration in FIG. 15, the first opening portions Na of the respective nozzles N can be disposed in the staggered shape. Furthermore, in comparison with a case where not only the first opening portions Na but also the second opening portions Nb are shifted in the Y direction, it is possible to suppress the variation in the discharge characteristics of the nozzle N even in a disposition of the staggered shape. Furthermore, since the first opening portions Na are disposed so as to be shifted in the Y direction, the liquid droplet of the ink discharged through each of the nozzles N is less affected by the vortex flow. Accordingly, it is possible to suppress the shift of the landing position of the liquid droplet of the ink to the medium 11, and it is thus possible to suppress generation of the wind ripple or the like. As described above, according to the configuration of the second embodiment, while reducing the variation in the discharge characteristics of the nozzle N, it is possible to suppress the shift of the landing position of the liquid droplet to the medium 11.

Variation

Each of the embodiments described above as an example can be variously changed. Specific modes of the change will be described below as examples. Two or more modes arbitrarily selected from examples described below can be appropriately combined in a range not contradicting each other.

(1) Although the above-described embodiments describe the liquid discharge head 20 of a piezoelectric system using a piezoelectric element as a driving element (pressure generating element) applying mechanical vibration to the pressure chamber as an example, it is also possible to employ a liquid discharge head of a heating system using a thermal element which generates bubbles in the pressure chamber by heating.

(2) The liquid discharge apparatus described as an example in the above-described embodiments can be employed in various apparatuses such as a facsimile machine, a copying machine, or the like, in addition to an apparatus dedicated to printing. However, the application of the liquid discharge apparatus of the invention is not limited to printing. For example, the liquid discharge apparatus discharging a color material solution is used as a manufacturing apparatus for forming a color filter of a liquid crystal display device. Additionally, the liquid discharge apparatus for discharging a solution of a conductive material is used as a manufacturing apparatus for forming a wire or an electrode of a wiring substrate.

What is claimed is:

1. A liquid discharge apparatus comprising:

a nozzle plate having a plurality of nozzles;

a pressure chamber communicating with the plurality of nozzles; and a pressure generating element causing a change in pressure of liquid in the pressure chamber to be generated and the liquid to be discharged through the plurality of nozzles, wherein each of the plurality of nozzles is formed by communicating a first opening portion on a discharge side of the liquid and a second opening portion on the pressure chamber side, when two nozzles adjacent to each other among the plurality of nozzles are represented by a first nozzle and a second nozzle, the second opening portion of the first nozzle and the second opening portion of the second nozzle are disposed along a first direction, each of the second opening portions extends in a second direction orthogonal to the first direction, each of the second opening portions being shorter than the pressure chamber in the second direction, and an inner diameter of the second opening portion in the second direction is larger than an inner diameter of the first opening portion, the first opening portion of the first nozzle and the first opening portion of the second nozzle are disposed so as to be shifted from each other in the second direction, and the second opening portion of the first nozzle and the second opening portion of the second nozzle are disposed so that centers of the second opening portions in the second direction are aligned.

2. The liquid discharge apparatus according to claim 1, wherein an arrangement of the first opening portion of the first nozzle and the first opening portion of the second nozzle adjacent to each other does not include an arrangement in which the first opening portion of one of the first nozzle and the second nozzle is disposed at a center portion of the second opening portion in a lengthwise direction, and the first opening portion of the other of the first nozzle and the second nozzle is disposed at an endmost portion of the second opening portion in the lengthwise direction.

3. The liquid discharge apparatus according to claim 2, wherein the first opening portion of the first nozzle and the first opening portion of the second nozzle are line-symmetrically disposed, interposing an imaginary straight line along the first direction passing through the center of each of the second opening portions in the lengthwise direction, on both sides of the imaginary straight line in the lengthwise direction.

4. The liquid discharge apparatus according to claim 3, wherein an arrangement of the plurality of nozzles is an arrangement in which the first nozzle and the second nozzle in which the first opening portions are line-symmetrically disposed are alternately disposed one by one every other nozzle.

5. The liquid discharge apparatus according to claim 1, wherein the first opening portions of the plurality of nozzles are disposed in a straight line shape intersecting with the first direction.

6. The liquid discharge apparatus according to claim 1, wherein the first opening portions of the plurality of nozzles are disposed in a curved line shape of convex or concave in the second direction.

7. The liquid discharge apparatus according to claim 1, wherein the second opening portion of the first nozzle and the second opening portion of the second nozzle are disposed so that ends of the second opening portions in the second direction are lined.

* * * * *